United States Patent [19]

Jones

[11] Patent Number: 4,601,262

[45] Date of Patent: Jul. 22, 1986

[54] ENERGY BALANCE PROCESS FOR THE PULP AND PAPER INDUSTRY

[76] Inventor: Dallas W. Jones, 2773 Johnson Rd., Germantown, Tenn. 38138

[21] Appl. No.: 567,941

[22] Filed: Mar. 28, 1984

[51] Int. Cl.[4] ..... F22D 1/00

[52] U.S. Cl. ..... 122/7 R; 122/1 R; 122/4 A; 162/36; 162/47

[58] Field of Search ..... 110/233, 234, 235, 216, 110/346; 122/1 R, 1 B, 6 R, 7 R, 7 C, 4 A; 162/36, 47, 232, 233

[56] References Cited

U.S. PATENT DOCUMENTS

| | | | |
|---|---|---|---|
| 2,840,454 | 6/1958 | Tomlinson et al. | 110/346 |
| 3,183,145 | 5/1965 | Collins, Jr. | 162/47 |
| 3,595,742 | 7/1971 | Hess et al. | 162/36 |
| 3,607,619 | 9/1971 | Hess et al. | 162/36 |
| 3,657,064 | 4/1972 | Shick | 162/36 |
| 3,719,705 | 3/1973 | Mita et al. | 162/36 |
| 4,094,813 | 6/1978 | Champagne | 122/7 R |
| 4,227,966 | 10/1980 | Ivnas et al. | 162/36 |
| 4,259,147 | 3/1981 | Gordy | 162/47 |
| 4,344,920 | 8/1982 | Isserlis | 110/216 |
| 4,347,226 | 8/1982 | Audeh et al. | 110/346 |
| 4,377,439 | 3/1983 | Liem | 122/7 C |
| 4,401,510 | 8/1983 | Olson et al. | 162/47 |
| 4,431,617 | 2/1984 | Farin | 162/36 |
| 4,532,413 | 7/1985 | Ahonen | 122/4 A |

*Primary Examiner*—Albert J. Makay
*Assistant Examiner*—Steven E. Warner

[57] ABSTRACT

The process described is a novel use of two complementary processes, the first of which provides the product to be converted into energy by the second process, related in such a way that the two combined provides an alternative to conventional fuels at a significant economical advantage. Specifically, the burning of sulfur with air or oxygen produces sulfur dioxide which can be combined with water to form sulfuric acid and by electrolysis, the sulfuric acid and water is converted to hydrogen gas. Hydrogen gas is burned as has been the sulfur, each producing thermal energy which is used to produce steam. The steam produced by burning the two fuels, sulfur and hydrogen gas, is used in the pulp mill in exactly the same manner as has been steam produced by burning fuels such as natural gas, fuel oil, coal and wood.

2 Claims, 2 Drawing Figures

GENERAL PLANT LAYOUT
(ONE TON PULP OUTPUT)

SUMMARY STEAM PLANT LAYOUT
(ONE TON SULFUR)

ENERGY BALANCE PROCESS FOR THE PULP AND PAPER INDUSTRY

The process described is a novel use of two complimentary processes, the first of which provides energy in the form of steam and a by-product converted by the second into a fuel which may be burned to provide direct heat or additional steam, thereby doubling the amount of energy obtained from the fuel supplied the first source, and a final by-product that may be utilized or sold to reduce or offset the overall cost of the process. The process is inherently clean in that no pollution must be released to the atmosphere or environment as in the case of burning fossil based fuels. The process depends on domestic fuel thereby eliminating dependance upon foreign resources. The final by-product may be used as a fertilizer and returned to the soil from which it was originally taken, thereby completing or balancing the energy and material use in the process. Careful management and balancing of the extent to which the fuel resource is used in a pulp mill may actually reduce the cost of purchased energy to zero and return a profit from the overall process.

Specifically, the primary fuel is low cost sulfur mined in the western United States or obtained as a by-product from petroleum refining. Sulfur, when burned with air produces heat and sulfur dioxide. The sulfur dioxide may be converted into hydrogen and sulfuric acid by an electrolysis process after which the hydrogen may be burned to provide a roughly equal amount of heat as obtained from the sulfur. The sulfuric acid may be utilized in the pulp mill, as a feedstock for other plants that might be located on the pulp mill site, or it may be sold as a feedstock for the manufacture of fertilizer.

BACKGROUND OF THE INVENTION

Energy use in a typical sulfate pulp mill, sometimes referred to as a Kraft mill, is a major operating expense and contributes a significant percent of cost of pulp, as much or more than the wood chips used to manufacture pulp. The conventional fuels have been in order of use: natural gas, fuel oil, coal and wood wastes from the forest or other wood processing plants such as sawmills, chipboard plants or plywood plants. Economic factors have affected each of these fuels so as to increase their costs, subjecting the pulp manufacturer to increasing energy costs.

Energy is used primarily as large quantities of thermal energy convertible into steam for use as the primary medium of heat transfer in a pulp mill. Steam is used in the heating of the wood chip digester, in the extraction of processing chemicals from the pulp, for recovering processing chemicals and in the drying of the pulp. Steam is usually generated in a boiler system which consists of a furnace with heat exchanger coils to conduct water through the combustion chamber where it is turned into steam. The steam is then conveyed by pipes to the locations within the pulp mill where it is to be used. In a large 1000 ton per day mill, as much as one million pounds of steam an hour may be required in the manufacturing process. It is this demand for steam and its generation that the process described in this patent addresses.

SUMMARY OF THE PROCESS

Figure 1:
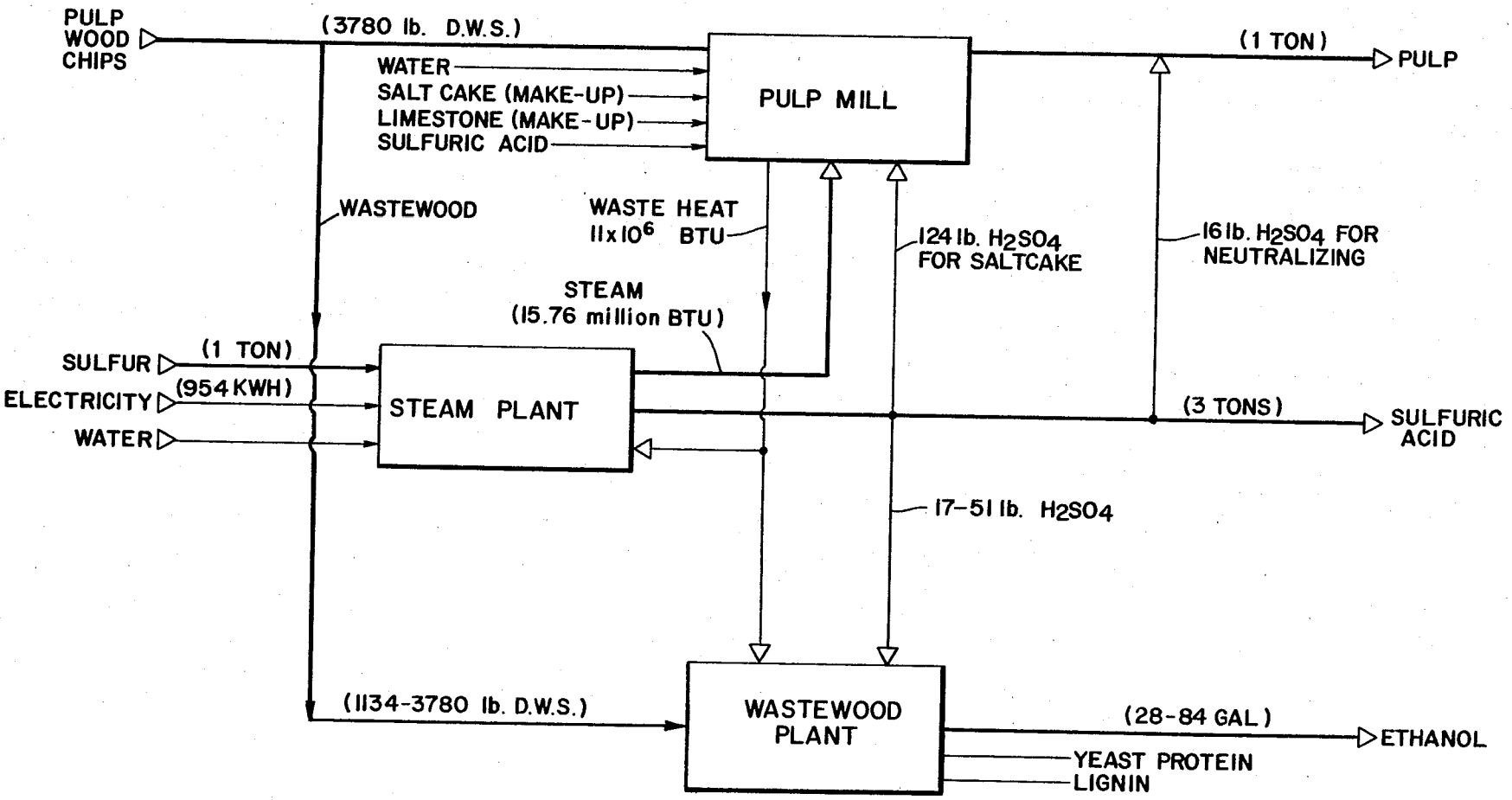
FIG. 1 is a summary of a general plant layout illustrating the location of the steam plant in relation to other plants that might interact with the steam plant by using steam or sulfuric acid generated by the steam plant.

FIG. 1 outlines the overall process. As illustrated in FIG. 1, for the production of 1 ton of dry pulp, about 3780 lb of dry wood solids (d.w.s.) are processed in the pulp mill along with water, salt cake, limestone and sulfuric acid and approximately 15 million BTU of energy in the form of steam for the production of each ton of dry pulp. The pulp mill also produces, or loses, approximately 11 million BTU of waste heat.

Steam for the pulp mill may be supplied by burning one ton of sulfur in the steam plant with the additional consumption of about 954 KWH of electricity. The steam plant will also use waste heat from the pulp mill in the connection of sulfuric acid that it supplies for the pulp mill, use in a wastewood plant, and as a by-product for sale in the fertilizer industry. The design and combination of industrial processes used in the steam plant is the primary subject of this patent.

Wastewood from the pulp wood harvesting process, or wastes from the pulp mill, may be treated with sulfuric acid from the steam plant to produce yeast, protein, lignin and 28 gallons of ethanol for each 1134 lb d.w.s. feedstock. About 17 lb of sulfuric acid are required.

The wastewood plant is not a subject of this patent as the technology is already in use by industry; but the technique of including an ethanol plant, or plant with similiar characteristics, or a different industrial process not involving ethanol production to reduce the sensitivity of steam plant profitability to variations in the sulfuric acid market is a subject of this patent.

By careful balancing of the relative capacity of the pulp mill, steam plant and wastewood plant and management of energy and materials flow, the cost of the 15 million BTU of steam supplied to the pulp mill can be reduced from the cost that would be incurred for production of this energy from fossil based fuels, completely offset and a profit actually returned. The current approximate cost of energy at a pulp mill is about $65 per ton of pulp produced, which accounts for about fifteen percent of the cost of producing pulp. Studies of this process show that this energy can be provided plus a profit returned on the sale of by-products that will offset the cost of producing energy and still provide a profit that would be sufficient to reduce the cost of producing pulp by about one-third of the current cost of production.

DETAILED DESCRIPTION OF THE PROCESS

Figure 2:
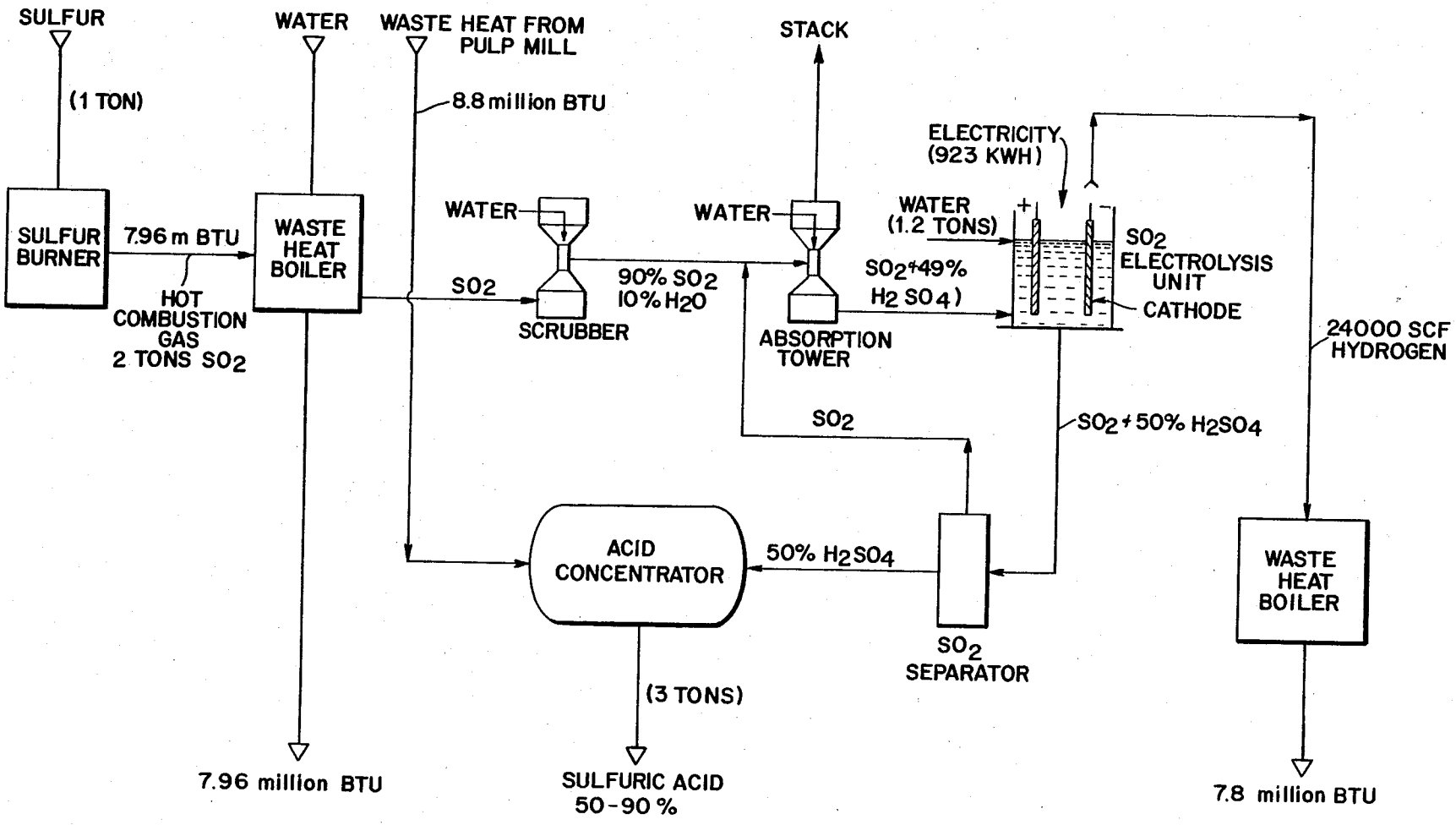
FIG. 2 illustrates the plan for construction of the steam plant showing each component and the connection of components to other units of the plant.

FIG. 2 illustrates the detailed construction of the steam plant. All components of this plant are standard off-the-shelf products, or at least they require minimum modification, and the process included are currently used in the industry; but the combination of the processes as described herein is novel and unique and has not heretofore been used. The process is described for the production of 1 ton of pulp in a pulp mill.

Approximately 1 ton of sulfur is burned in a sulfur burner to produce 7.96 million BTU of hot combustion gases and 2 tons of sulfur dioxide ($SO_2$). The hot combustion gasses and sulfur dioxide is passed through a waste heat boiler in which steam is produced from water provided from reservoirs or as waste water from the pulp mill. The sulfur dioxide gas is passed through a scrubber used only to mix the gases with water to obtain a mixture of about 90% sulfur dioxide and 10% water and then to an absorption tower used only to further mix water with the sulfur dioxide gas to obtain a mixture of about 49% sulfur dioxide and sulfuric acid.

The resulting mixture is passed into a sulfur dioxide electrolysis unit where 24,000 cubic feet of hydrogen is produced. The by-product consisting of a mixture of sulfur dioxide and sulfuric acid is recycled through a sulfur dioxide separator from which sulfur dioxide is returned to the absorption tower for cycling through the electrolysis unit again and the 50% solution of sulfuric acid is passed to an acid concentrator. The sulfur dioxide is recycled and never released to the atmosphere except by unintended leakage thereby rendering the process inherently pollution free. The hydrogen produced in the process is burned to produce approximately 7.8 million BTU of energy in the form of steam or for use as direct heat. The result is therefore doubling of the energy obtained normally from the burning of sulfur with only the addition of 923 KWH of electricity.

Waste heat from the pulp mill is used to concentrate the 50% sulfuric acid to the range of 92 to 96% sulfuric acid, which is subsequently sold for use in the fertilize industry or it may be used in the pulp mill or in a wastewood plant for production of ethanol. About 3 tons of acid are produced. Some of the acid may be used in a less pure form than the commercial grade of sulfuric acid produced for shipment.

The following cash flow analysis illustrates the cost of supplying energy before and after credit is taken for sulfuric acid as a by-product. This analysis is not intended to base this process on any one particular cost of sulfur as a feedstock, and several costs are considered in the analysis to demonstrate that the process can be successful as the cost of sulfur increases or decreases from present day standards. For the purpose of analysis, the cost of electricity is taken as $44 per 1000 KWH, and the cost of operating a steam plant is based upon industrial experience at $24 per ton sulfur consumed. These assumptions may also vary greatly without significant impact on the feasibility of the process.

TABLE 1

Production of Energy in Steam Plant

| | Dollars per ton sulfur(S) processed | | | | |
|---|---|---|---|---|---|
| Sulfur (1 ton) | 25 | 50 | 75 | 100 | 120 |
| Electricity (954 KWH) | 41 | 41 | 41 | 41 | 41 |
| Operational Costs | 24 | 24 | 24 | 24 | 24 |
| Production Cost | (90) | (115) | (140) | (165) | (190) |
| Sulfuric Acid Credit | 75 | 150 | 225 | 300 | 170 |
| Net Profit (loss) | (15) | 35 | 85 | 135 | 170 |

For example, this analysis shows the total cost of producing energy in the case of sulfur purchased at $50 per ton to be actually a profit of $35 per ton of sulfur used. The steam plant would supply the energy, normally purchased by a pulp mill at a cost of about $65, and in addition allow for a profit of $35 through sale of its sulfuric acid by-product. Together the production of energy and revenue from sale of the sulfuric acid by-product would account for a reduction of the cost of producing 1 ton of pulp by $100, or approximately one-third of the cost of producing pulp in 1983.

As an alternative, the percentage of sulfuric acid utilized effectively may be reduced to obtain only a zero cost of energy. As another option, sulfuric acid may be sold for a lower price. For the purposes of the analysis in Table 1, the sale price of sulfuric acid was taken as the same price per ton as that of purchased sulfur. One ton of sulfur results in a final by-product of three tons of sulfuric acid.

The effective realization of energy cost reduction and profitability of this process depends upon the integration of the steam plant into the pulp mill and securing a use or market for the sulfuric acid by-product. The sulfuric acid may be sold on the market for manufacture of fertilize as an example; and variations in the market, or market price, of sulfuric acid may be reduced in their impact upon profitability if another plant or industrical process that uses sulfuric acid as a feedstock is also integrated with the pump mill and steam plant.

One way in which sulfuric acid by-product can be effectively utilized at the pulp mill site is through the production of ethanol from wastewood from the pulp harvesting process. Wastewood from the pulp harvesting process, or wastes from the pulp mill, may be treated with sulfuric acid from the steam plant and waste heat from the pulp mill to produce 28 gallons of ethanol and additional products of yeast, protein and lignin for each 1134 lb d.w.s. feedstock. Approximately 15 lbs of sulfuric acid are required for treatment of the wastewood, a small fraction of the sulfuric acid which might be produced in a steam plant supplying energy for production of a ton of dry pulp. An advantage of including an ethanol plant on the pulp mill site is that the ethanol plant would use woodwaste as its primary feedstock but only a small fraction of the sulfuric acid available. Therefore, the ethanol plant would provide an additional method of generating revenue to offset the cost of operating a steam plant without reducing significantly the profitability of the steam plant through sale of sulfuric acid. The additional revenue from an ethanol plant would also reduce sensitivity of the steam plant profitability to variations in the market for sulfuric acid or the market place.

The economic analysis outlined in Table 2 illustrates the practical application of the steam plant for reducing energy costs of a pulp mill and the inclusion of an ethanol plant to reduce variations in the market or market price of sulfuric acid. The basis for this table is a 1,000 tpd pulp mill which will require about 13 million BTU of energy per ton of pulp produced. To provide this energy, the pulp mill would normally purchase energy to a cost of about $5 per million BTU which would result in a cost of $65 per ton of pulp produced or $65,000 per day for a 1,000 tpd pulp mill. Three cases are considered. The first case corresponds to a small steam plant selected due to lack of a market for sulfuric acid or because of other sources of steam which reduce demand on the steam plant for energy and a relatively large ethanol plant that would utilize the same volume of wastewood as pulp wood required by the pulp mill. The third case corresponds to a large steam plant and a relatively small ethanol plant.

TABLE 2

Balancing Pulp, Steam and Ethanol Plants

| Consideration | Units | Case 1 | Case 2 | Case 3 |
|---|---|---|---|---|
| Pulp Mill Capacity | tpd (P) | 1,000 | 1,000 | 1,000 |
| Steam Plant Capacity | tpd (S) | 250 | 500 | 1,000 |
| Ethanol Plant Capacity | gpd (E) | 90,000 | 70,000 | 30,000 |
| Energy Purchased (1) | dpd | $48,750 | $32,500 | 0 |
| Steam Plant Profit (2) | dpd | $8,750 | $17,500 | $35,000 |
| Ethanol Plant Profit (3) | dpd | $127,800 | $99,400 | $42,600 |

TABLE 2-continued

| Balancing Pulp, Steam and Ethanol Plants | | | | |
|---|---|---|---|---|
| Consideration | Units | Case 1 | Case 2 | Case 3 |
| Net Profit (Loss) | | $87,800 | $84,400 | $77,600 |

P: Pulp
S: Sulfur
E: Ethanol
(1) Based upon $5 per MMBTU and 13 MMBTU/ton pulp
(2) Based upon $50 per ton sulfur (Table 1)
(3) Based upon $1.42 per gallon profit In case 1, the 250 tpd(S) steam plant will produce about one-fourth the energy needed by the pulp mill with proportionate reduction of energy costs from $65,000 to $48,750 per day. A profit of $8,750 per day will be realized from the steam plant if all the sulfuric acid is sold, and the 90,000 gpd(E) plant will produce a profit of $127,800 per day for a total net profit of $87,800. In this case, the pulp mill will have offset its total cost of energy plus generation of a net profit of $87,800 per day.

In Case 3, the capacity of the steam plant has been increased to 1,000 tpd(S) and the capacity of the ethanol plant decreased to 30,000 gpd(E). In this case, the steam plant will produce 100% of the energy needs of the pulp mill thereby reducing the cost of purchased energy to zero. At the same time, a profit of $35,000 per day should be realized from the steam plant through sales of sulfuric acid as a by-product, and a profit of $42,600 should be realized from the ethanol plant through sales of ethanol. The net result is similiar to case 1 and may be the reduction of energy cost from $65,000 per day to zero and generation of a profit of $77,600 from the energy producing processes.

The 500 tpd(S) steam plant of case represents a compromise between the extremes of cases 1 and 3 with a similar result. In this case the cost of energy has been offset and a net profit of $84,400 per day generated. Similar tables may also be generated by consideration of cases in which steam and ethanol plants are constructed, but operated at partial capacity or limited sales of by-products, etc.

The net result of each case is similar representing that the energy costs of a 1,000 tpd(P) can be reduced to zero plus the generation of a net profit of approximately $80,000 per day through sales of by-products from the energy producing processes. The particular combination, or balance, of the plant capacities then becomes that combination that will match a reasonable supply of energy for the pulp mill, potential sales of sulfuric by product, and availability of wastewood, and potential sales of ethanol for the plant employing the process. Other combinations plant capacities and lesser than total sales of by-products may also be selected to achieve greater or lesser profit from the overall process, depending upon the balance that may best apply to the plant under consideration.

It is therefore claimed for this patent as follows:

1. A pollution free process for the production of steam and energy by the burning of sulfur and an electrolysis of the by-products of burning sulfur mixed with water comprising the steps of: burning a requisite amount of sulfur in a sulfur burner to produce hot combustion gas and sulfur dioxide; passing said hot combusion gas and said sulfur dioxide directly through a waste heat boiler in addition to water provided from a source and utilizing the heat exchange between said hot combusion gas, said sulfur dioxide, and said water to produce steam, cooled sulfur dioxide, and cooled combustion gases; passing said cooled sulfur dioxide while supplying water to a closed scrubber used only to mix said cooled sulfur dioxide with said supplied water to provide a constant feedstream of about 90% sulfur dioxide and about 10% water without losing any sulfur dioxide to the environment; passing said feedstream to an absorption tower while supplying additional water to obtain a mixture of about 49% sulfur dioxide and sulfuric acid; passing said mixture into a sulfur dioxide electrolysis unit to produce hydrogen and by-products consisting of a second mixture of sulfur dioxide and sulfuric acid; burning said hydrogen produced in said process to further produce energy in the form of steam or for use as direct heat.

2. A steam and energy production process according to claim 1, further comprising the steps of: recycling said second mixture through a sulfur dioxide separator to separate said second mixture into separated sulfur dioxide and separated sulfuric acid; supplying said separated sulfur dioxide to said absorption tower for cycling through said electrolysis unit; passing said separated sulfuric acid to an acid concentrator while utilizing waste heat from a pulp mill or the like to concentrate said separate sulfuric acid for use.

* * * * *